United States Patent [19]

Burckett St. Laurent et al.

[11] Patent Number: 4,698,167

[45] Date of Patent: Oct. 6, 1987

[54] DETERGENT WITH FABRIC SOFTENER

[75] Inventors: James C. T. Burckett St. Laurent, Overijse; Alfred Busch, Grimbergen, both of Belgium

[73] Assignee: The Procter & Gamble Company, Cincinnati, Ohio

[21] Appl. No.: 868,477

[22] Filed: May 30, 1986

Related U.S. Application Data

[63] Continuation of Ser. No. 632,572, Jul. 19, 1984, abandoned.

[30] Foreign Application Priority Data

Aug. 11, 1983 [GB] United Kingdom ..... 8321683

[51] Int. Cl.[4] ..... D06M 1/24

[52] U.S. Cl. ..... 252/8.8; 252/117

[58] Field of Search ..... 252/8.8, 117

[56] References Cited

U.S. PATENT DOCUMENTS

| | | | |
|---|---|---|---|
| 3,936,537 | 2/1976 | Baskerville, Jr. et al. | 427/242 |
| 3,966,629 | 7/1986 | Dumbrell | 252/140 |
| 4,237,155 | 12/1960 | Kardouche | 427/242 |
| 4,292,035 | 9/1981 | Batrell | 8/137 |
| 4,294,710 | 10/1981 | Hardy et al. | 252/8.8 |
| 4,316,812 | 2/1982 | Hancock et al. | 252/99 |
| 4,338,204 | 7/1982 | Spadini et al. | 252/8.75 |
| 4,375,416 | 3/1983 | Crisp et al. | 252/8.7 |

FOREIGN PATENT DOCUMENTS

| | | |
|---|---|---|
| 1164470 | 3/1984 | Canada . |
| 0000225 | 10/1979 | European Pat. Off. . |
| 1400898 | 7/1975 | United Kingdom . |
| 1514276 | 6/1978 | United Kingdom . |

*Primary Examiner*—Paul Lieberman
*Assistant Examiner*—John F. McNally

[57] ABSTRACT

Granular detergent compositions with through-the-wash fabric softening properties are prepared from conventional detergent ingredients, clay fabric softeners, and microfine particles of a complex of long-chain amine and fatty acid. The amine fatty acid complex provides fabric softening performance in the compositions when fabrics washed therein are dried. Importantly, the drying operation can be simple line-drying and machine drying is not required to secure the benefits of the invention, although machine drying may be used, if desired.

6 Claims, No Drawings

DETERGENT WITH FABRIC SOFTENER

This is a continuation of application Ser. No. 632,572, filed July 19, 1984, now abandoned.

TECHNICAL FIELD

The present invention relates to detergent compositions with fabric softening properties. Microfine particles of amine-fatty acid complex in the compositions provide through-the-wash fabric softness and anti-static benefits. Detergent compositions in spray-dried form containing said microfine particles are disclosed. Preferred compositions also contain a smectite clay for additional softening benefits.

BACKGROUND

The use of softeners to treat fabrics subsequent to a washing operation is a well-known laundering practice. Fabric softeners are, in the main, cationic materials which are incompatible with anionic detersive surfactants used in most fabric washing compositions. For that reason, the softening operation is generally carried out in the laundry rinse bath after the surfactant has been removed from the washing machine. This entails additional work for the user.

Formulators of fabric laundering compositions have long sought means whereby the fabric washing and softening could be done concurrently. Methods employing clay softeners, mixtures of clays and various amine materials, and the like, are described in the following patents: German Nos. 29/64114.3, 28/57163.3, 24/39541.3, 23/34899.4 and EPO Nos.80200570.2, 80200877.1 and 80201015.7. The use of mixtures of amines and soaps (salts of fatty acids) as through-the-wash softeners is disclosed in U.K. Pat. No. 1 514 276. The present invention employs a microfine dispersion of an amine.fatty acid complex in an otherwise conventional spray-dried detergent composition matrix, and clay, to provide cleaning and softening concurrently, through-the-wash.

SUMMARY OF THE INVENTION

The compositions herein may be described succinctly as detergent compositions (preferably, spray-dried) which may contain conventional detergent ingredients such as detersive surfactants (including anionics), detergency builders, optical brighteners, detersive enzymes, fabric bleaches, and the like, all at conventional levels, as well as clay fabric softeners (preferably, smectite clays), said compositions being characterized in that they contain at least 0.1% (preferably 1.0% to 20%) of a microfine dispersion of a complex of a fatty acid of the formula R COOH where R is $C_9$ to $C_{20}$ and an amine of the formula $R_1R_2R_3N$ where $R_1$ is $C_6$ to $C_{20}$, $R_2$ is $C_6$ to $C_{20}$ and $R_3$ is $C_1$ to $C_{10}$ or hydrogen.

The ingredients and means for preparing the compositions are disclosed more fully hereinafter. All weights and proportions are by weight, unless otherwise specified.

DETAILED DESCRIPTION OF THE INVENTION

As noted hereinafter, the compositions of this invention comprise, in major part, conventional ingredients that are quite familiar to formulators of granular detergent compositions. One of the major advantages of the amine.fatty acid complexes used herein is that they are entirely compatible with such conventional detergent ingredients, used at conventional concentrations.

Amine Fatty Acid Complex

In general terms, the amine fatty acid complexes which are key to this invention are prepared separately from the balance of the composition, and are preferably then added to the conventional detergent ingredients in such a way as to ensure that the complexes are homogeneously dispersed therein as microfine particles. This can most conveniently be done by preparing a melt (preferably 1:1 mole ratio) of the fatty acid and the amine, maintaining the melt stage for about ten minutes whereby the complex forms, dispersing the molten complex into a stirred, aqueous crutcher mix comprising the balance of the detersive ingredients, and spray-drying in standard fashion. In alternate but much less preferred modes, the melt can be atomized onto the detergent granule or allowed to solidify, ground in a colloid mill, and dry-mixed with the balance of the detergent composition.

The amine fatty acid complexes are characterized by their microfine particle size, i.e., preferred microfine particles substantially all pass through a Millipore (TM) filter of 10 micron size, and the majority of particles pass through a 7 micron filter.

The complexes are further characterized by their melting points, which lie generally in the range of 32°–65° C., preferably around 42° C. for the most preferred complex, which comprises di-hardened tallow methyl amine complexed with a 70:30 mix of lauric/myristic acids, in 1:1 stoichiometry.

While not intending to be limited by theory, it appears that, in-use, the heat of the wash water (30°–90° C.) softens the particle and disrupts hydrogen bonding. The particle deposits on fabrics, to provide a lubricious feel.

Typical examples of amine:fatty acid complexes useful herein include the complexes of ditallow-, dicoconut, dipalm oil - chain length methyl, ethyl and propyl tertiary amines and (less preferably) similar di-fatty chain length secondary amines, with nonanoic, lauric, myristic, palmitic, stearic, oleic and mixed fatty acids. Excess fatty acids can be used to form the complexes (1:1 complex plus one part extra acid) and perform well in the detergent compositions; complexes that are less than stoichiometric (e.g. 1:0.5 amine:fatty acid) perform somewhat less well.

The amine.fatty acid complexes are typically used herein at levels of 0.5%, most preferably 1% to 5%, of the detergent compositions, especially when softener clay is present.

Softener Clay: The amine fatty acid complex is preferred, but not limited, for use in combination with a detergent-compatible clay softener. Such clay softeners are well-known in the detergency patent literature and are in broad commercial use, both in Europe and in the United States. Included among such clay softeners are various heat-treated kaolins and various multi-layer smectites. Preferred clay softeners are smectite softener clays that are described in German patent document No. 2 334 899 and in U.K. Pat. No. 1 400 898, which can be referred to for details. Softener clays are used in the preferred compositions at levels of at least 1%, generally 1–20%, preferably 2–7%.

Detersive Surfactants— The compositions of this invention will typically contain organic surface-active agents ("surfactants") to provide the usual cleaning benefits associated with the use of such materials.

Detersive surfactants useful herein include well-known synthetic anionic, nonionic, amphoteric and zwitterionic surfactants. Typical of these are the alkyl benzene sulfonates, alkyl-and alkylether sulfates, paraffin sulfonates, olefin sulfonates, alkoxylated (especially ethoxylated) alcohols and alkyl phenols, amine oxides, α-sulfonates of fatty acids and of fatty acid esters, and the like, which are well-known from the detergency art. In general, such detersive surfactants contain an alkyl group in the $C_9$–$C_8$ range; the anionic detersive surfactants can be used in the form of their sodium, potassium or triethanolammonium salts; the nonionics generally contain from about 5 to about 17 ethylene oxide groups. U.S. Pat. Nos. 4,111,855 and 3,995,669 contain detailed listings of such typical detersive surfactants. $C_{11}$–$C_{16}$ alkyl benzene sulfonates, $C_{12}$–$C_{18}$ paraffin-sulfonates and alkyl sulfates, and the ethoxylated alcohols and alkyl phenols are especially preferred in the compositions of the present type.

Also useful herein as the surfactant are the watersoluble soaps, e.g. the common sodium and potassium coconut or tallow soaps well-known in the art.

The surfactant component can comprise as little as 1% of the compositions herein, but preferably the compositions will contain 5% to 40%, preferably 10% to 30%, of surfactant. Mixtures of the ethoxylated nonionics with anionics such as the alkyl benzene sulfonates, alkyl sulfates and paraffin sulfonates are preferred for through-the-wash cleansing of a broad spectrum of soils and stains from fabrics.

Detersive Adjuncts— The compositions herein can contain other ingredients which aid in their cleaning performance. For example, it is highly preferred that through-the-wash detergent compositions contain a detergent builder and/or metal ion sequestrant. Compounds classifiable and well-known in the art as detergent builders include the nitrilotriacetates, polycarboxylates, citrates, watersoluble phosphates such as tri-polyphosphate and sodium ortho- and pyro-phosphates, silicates, and mixtures thereof. Metal ion sequestrants include all of the above, plus materials like ethylenediaminetetraacetate, the amino-polyphosphonates and phosphates (DEQUEST) and a wide variety of other poly-functional organic acids and salts too numerous to mention in detail here. See U.S. Pat. No. 3,579,454 for typical examples of the use of such materials in various cleaning compositions. In general, the builder/sequestrant will comprise about 0.5% to 45% of the composition. The 1–10 micron size zeolite (e.g. zeolite A) builders disclosed in German Pat. No. 2,422,655 are especially preferred for use in low-phosphate compositions which contain the amine.fatty acid complex.

The laundry compositions herein also preferably contain enzymes to enhance their through-the-wash cleaning performance on a variety of soils and stains. Amylase and protease enzymes suitable for use in detergents are well-known in the art and in commercially available liquid and granular detergents. Commercial detersive enzymes (preferably a mixture of amylase and protease) are typically used at levels of 0.001% to 2%, and higher, in the present compositions.

Moreover, the compositions herein can contain, in addition to ingredients already mentioned, various other optional ingredients typically used in commercial products to provide aesthetic or additional product performance benefits. Typical ingredients include pH regulants, perfumes, dyes, bleach, optical brighteners, soil suspending agents, hydrotropes and gel-control agents, freeze-thaw stabilizers, bactericides, preservatives, suds control agents, bleach activators and the like.

In a through-the-wash mode, the compositions are typically used at a concentration of at least 500 ppm, preferably 0.10% to 1.5%, in an aqueous laundry bath at pH 7–11 to launder fabrics. The laundering can be carried out over the range from 5° C. to the boil, with excellent results.

INDUSTRIAL APPLICATION

The following examples are typical of the preferred compositions of this invention containing excellent smectite softener clays, but are not intended to limit the scope of the invention.

EXAMPLE I

A mix of 70:30 lauric acid/myristic acid (total 1.5% of complete formulation) and di-hardened tallow methyl amine (total 1.7% of complete formulation) are admixed, melted in a jacketed batch, and maintained as a melt for about 10 minutes (excess heating may cause yellowing).

A standard aqueous crutcher mix comprising the following ingredients is prepared (precentages listed relate to percent ingredients in the complete formulation after spray-drying).

| Ingredients | Percent |
|---|---|
| $C_{11-12}$ alkyl benzene sulfonate | 6.2 |
| Tallow alcohol ethoxylate (EO11) | 1.0 |
| Sodium perborate | 20.0 |
| Sodium tripolyphosphate | 24.0 |
| Sodium sulfate | 22.0 |
| Sodium silicate | 8.0 |
| Smectite clay* | 2.4 |
| Ditallow methyl amine | 3.8 |
| Carboxymethyl cellulose | 0.4 |
| Polyacrylate (soil suspender) | 1.7 |
| Enzymes | 0.5 |
| Optical brightener | 0.23 |
| Sulphonated zinc phthalocyanine** | 25 ppm |
| EDTA | 0.2 |
| Perfume/copper salts/minors | 0.5 |
| Moisture | to 100 |

*Natural smectite; ion exchange capacity above 50 meg/100g clay
**U.S. Pat. No. 3 927 967

The pre-formed complex is poured into the stirred crutcher mix (60°–90° C.) as the final ingredient. (In general, it is preferred to add the complex to the crutcher after most of the ingredients have been added and thoroughly blended.) The crutcher mix-plus-complex is then handled in entirely standard fashion, and spray-dried to form the final composition. Analysis of an aqueous solution (clay-free product) indicates that the complex after crutching has a particle diameter in the range of 0.1–20 microns, generally around 7 microns.

The composition of Example I is free-flowing and exhibits excellent through-the-wash fabric softening performance when fabrics washed therewith are line-dried.

EXAMPLE II

A nil-P spray-dried detergent formulation is as follows:

| Ingredient | Percent |
|---|---|
| Zeolite A (1-10 micron) | 26.0 |
| Sodium nitriotriacetate | 5.0 |
| Smectite clay* | 3.0 |
| Amine.fatty acid complex** | 2.5 |
| $C_{11-12}$ alkyl benzene sulfonate (Na) | 6.5 |
| Tallow ethoxylate (EO 9-11) | 1.0 |
| Sodium perborate $4H_2O$ | 20.0 |
| Sodium silicate | 8.0 |
| CMC | 1.0 |
| Sodium sulfate | 20.0 |
| Enzymes (1:1 amylase/protease) | 1.5 |
| Optical brightener | 0.5 |
| Water, minors | to 100 |

*As Gelwhite GP (TM); ion exchange capacity >70 Meg/100 g.

**Prepared separately from mixed tallow fatty acids and mixed di-coconut monomethyl amine 1:1 mole ratio and added to crutcher as the melt.

The composition of Example II is prepared by spray-drying the aqueous crutcher mix. In use, the composition gives excellent cleaning and through-the-wash fabric softening performance.

In an optional mode, the composition of Example II may be modified by removing the clay and replacing it with an equivalent amount of amine.fatty acid complex.

We claim:

1. A method for imparting softening and anti-static properties to fabrics, said method comprising the steps of (a) laundering said fabrics in an aqueous laundry bath containing from 0.10% to 1.5% by weight of a detergent composition containing at least 0.1% by weight of an amine-fatty acid complex involving hydrogen bonding and formed from a fatty acid of the formula RCOOH and an amine of the formula $R_1R_2R_3N$ wherein R is $C_9$ to $C_{20}$, $R_1$ is $C_6$ to $C_{20}$, $R_2$ is $C_6$–$C_{20}$, and $R_3$ is $C_1$ to $C_{10}$ or hydrogen, the complex having an amine:fatty acid ratio of from about 1:2 to about 1:0.5 and being in the form of particles having a particle size in the range of from 0.1 to 20 microns, (b) line drying said fabrics after said laundering in aqueous laundry bath.

2. A method as recited in claim 1 wherein the detergent composition contains 1-5% by wight of said complex.

3. A method as recited in claim 2 wherein the particle size of the complex is 1-10 microns and the melting point is in the range of 32°-65° C.

4. A method as recited in claim 3 wherein the amine is ditallow monomethyl amine.

5. A method as recited in claim 4 wherein the fatty acid is a 70:30 mixture of lauric and myristic acid.

6. A method as recited in claim 4 wherein the fatty acid is tallow fatty acid.

* * * * *